US006222522B1

(12) United States Patent
Mathews et al.

(10) Patent No.: US 6,222,522 B1
(45) Date of Patent: Apr. 24, 2001

(54) BATON AND X, Y, Z, POSITION SENSOR

(75) Inventors: Max V. Mathews, Stanford; Thomas E. Oberheim, Orinda, both of CA (US)

(73) Assignee: Interval Research Corporation, Palo Alto, CA (US)

( * ) Notice: Subject to any disclaimer, the term of this patent is extended or adjusted under 35 U.S.C. 154(b) by 0 days.

(21) Appl. No.: 09/156,595

(22) Filed: Sep. 18, 1998

(51) Int. Cl.[7] ..... G09G 5/00

(52) U.S. Cl. ..... 345/156; 345/174; 178/19.01; 178/19.03; 178/19.07; 84/733; 84/735; 702/95

(58) Field of Search ..... 345/156, 173–179; 178/18.01, 18.03, 18.06, 19.03; 702/95

(56) References Cited

U.S. PATENT DOCUMENTS

| | | | | |
|---|---|---|---|---|
| 4,087,625 | * | 5/1978 | Dym et al. | 178/18.06 |
| 4,659,874 | * | 4/1987 | LAndmeier | 178/18.03 |
| 4,831,566 | * | 5/1989 | Matthews et al. | 702/95 |
| 4,980,519 | * | 12/1990 | Mathews | 178/19.01 |

* cited by examiner

*Primary Examiner*—Dennis-Doon Chow
*Assistant Examiner*—Amr Awad
(74) *Attorney, Agent, or Firm*—Pennie & Edmonds LLP

(57) ABSTRACT

A position sensor is used in conjunction with one or more batons, each baton having a transmitter that transmits a distinct radio frequency signal at a position in space. The position sensor determines the current position of each baton transmitter in terms of X, Y, and Z coordinates. The position sensor includes a tablet having a flat support member, with at least two pairs of electrodes coupled to the flat support member. Each of the electrodes is a separate antenna. A first pair of the electrodes is shaped so that the amount of capacitive coupling between each baton transmitter and the first pair of electrodes corresponds to the position of the baton transmitter with respect to the X axis. A second pair of the electrodes is shaped so that the amount of capacitive coupling between each baton transmitter and the second pair of electrodes corresponds to the position of the baton transmitter with respect to the Y axis. The regions forming the first pair electrodes are preferably interleaved with the regions forming the second pair of electrodes. The X, Y position of the baton can be computed with uniform accuracy anywhere in the X-Y plane by measuring the capacitance values between the baton and the four antennae.

20 Claims, 4 Drawing Sheets

BATON AND X, Y, Z, POSITION SENSOR

The present invention relates generally to man-machine interfaces and particularly to methods and systems for sensing the motion of a stylus, pointer, drum stick or baton over a surface.

BACKGROUND OF THE INVENTION

The present invention is a motion and position sensor that can be used as an electronic drum, much like an electronic keyboard is used with a musical synthesizer. The present invention can also be used for inputting one-dimensional, two-dimensional or three-dimensional data points into a computer or any other system.

The present invention uses a capacitive two-dimensional tablet as a position digitizer. Examples of other positional digitizers and capacitive two dimensional tablets are described in U.S. Pat. Nos. 4,705,919 (Dhawan), U.S. Pat. No. 3,999,012 (Dym), U.S. Pat. No. 4,087,625 (Dym et al.), and U.S. Pat. No. 4,659,874 (Landmeier). An earlier patent by the present inventor concerning a capacitive, two-dimensional tablet and position digitizer is U.S. Pat. No. 4,980,519 (Mathews), which is hereby incorporated by reference in its entirety as background information.

Objects of the present invention include providing improved uniformity in the accuracy over the X-Y-Z space in which a positioning member is moved, providing an antenna that allows for a position to be efficiently determined based on measured capacitances, and providing an antenna (i.e., capacitive tablet) that is readily fabricated on a two sided printed circuit board.

Another object of the present invention is to accurately detect the X, Y position of one or more batons or styluses, without regard to the strength of the signal emitted by the batons or styluses.

SUMMARY OF THE INVENTION

In summary, the present invention is a radio signal actuated electronic position sensor which operates in conjunction with one or more batons. Each baton has a transmitter that transmits a distinct radio frequency signal at a position in space. The position sensor determines the current position of each baton transmitter in terms of X, Y, and Z coordinates.

To determine the position of each baton transmitter, the position sensor includes a tablet having a flat support member at a predefined position, with at least two pairs of electrodes coupled to the flat support member. Each of the electrodes is a separate antenna. A first pair of the electrodes is shaped so that the amount of capacitive coupling between each baton transmitter and the first pair of electrodes corresponds to the position of the baton transmitter with respect to the X axis. A second pair of the electrodes is shaped so that the amount of capacitive coupling between each baton transmitter and the second pair of electrodes corresponds to the position of the baton transmitter with respect to the Y axis.

In one pair of antenna electrodes, each of the electrodes is comprised of a plurality of wedge shaped regions. The width of each of the regions of one electrode decreases linearly in the X direction and the width of each region of the second electrode increases linearly in the X direction. The width of each of the regions of an electrode in this pair is the same for any given Y position. Thus as a positioning member moves across the surface of the sensor in the Y direction, the width of each of the regions of an electrode in this pair is the same. At X positions other than the X-dimension midpoint of the sensor, the width of the second electrode regions is different from the width of the first electrode regions.

The second pair of antenna electrodes are comprised of narrow rectangular electrode regions. The widths of these electrode regions are constant in the X direction. The widths of the electrode regions of a first antenna in the pair increase linearly with increasing Y, and the widths of electrode regions of the second antenna in the pair decrease linearly with increasing Y. In a preferred embodiment, the regions forming the first pair of antenna electrodes are interleaved with the regions forming the second pair of antenna electrodes.

Capacitance is a linear function of the area of an electrode. The ratio of the areas of the antenna electrodes of the first pair of electrodes depends linearly on the X position of a baton transmitter, and is independent of the Y position. The ratio of the local areas of the second pair of antenna electrodes depends linearly on the Y position of the baton transmitter, and is independent of the X position. Thus by measuring the capacitance values between the baton and the four antennae, the X, Y position of the baton can be computed with uniform accuracy anywhere in the X-Y plane.

The position sensor also has a CPU which receives signals from the electrodes, and uses those signals to compute the X, Y and Z coordinates of each baton. The Z position of the baton transmitter is inversely proportional to the total capacitive coupling between the baton and either pair of electrodes.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
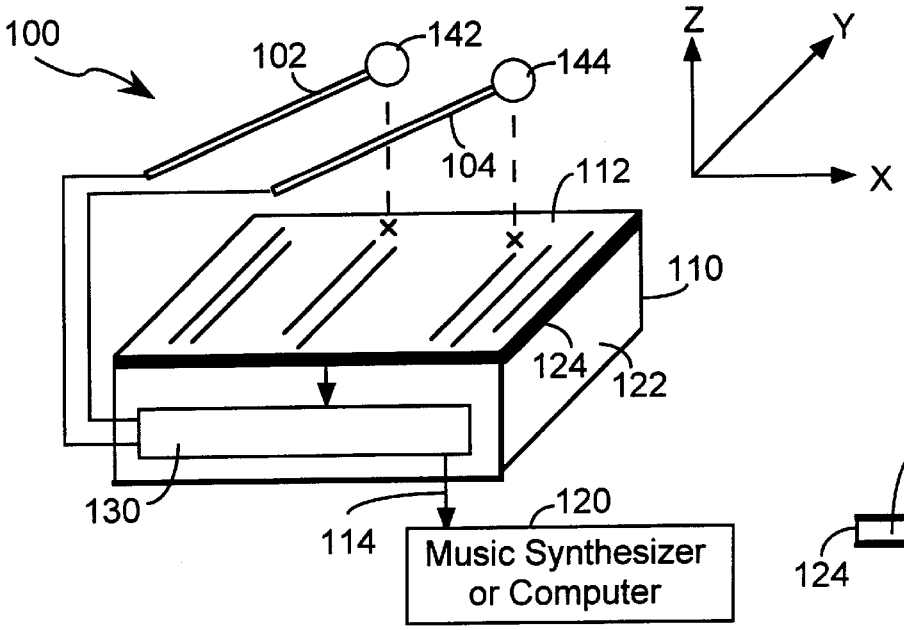
FIG. 1 is a block diagram of a system incorporating the present invention.

Referring to FIG. 1, there is shown a motion and position sensing system 100, which includes batons 102 and 104, a position sensor 110, and receiver electronics 130. The sensor 110 detects the (X,Y,Z) position of each of the batons relative to its top surface 112, and receiver electronics 130 generates corresponding position signals on signal line 114.

In the preferred embodiment, the position sensing system 100 is used in conjunction with a music synthesizer or computer 120, and the position signals transmitted over line 114 to the synthesizer are used to control various aspects of the synthesizer's operation. In a simple application, where the sensing system is used as a variable pitch drum, the X position of the baton 102 can be used to control the pitch of the drum beats generated by the synthesizer, the Y position of the baton 102 can be used to control the timbre of the drum, the velocity of the baton when it hits the surface 112 can be used to control the volume (also known as velocity) of the drum beats.

In other applications of the present invention, the apparatus 120 which receives the signals output by the sensing system 100 may be a computer.

Figure 1A:
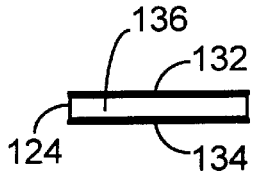
FIG. 1A illustrates a cross-sectional view of a capacitive tablet.

The position sensor 110 has a housing 122, which holds a sensing tablet 124 near its upper surface 112, and the receiver electronics 130. Referring to FIG. 1A, the sensing tablet 124 has four separate antennae formed on a conductive layer 132. The conductive layer 132 and a ground layer 134 are separated by an thin insulator layer 136, typically about a sixteen of an inch (0.16 cm) thick. In a preferred embodiment, the antennae (shown in FIG. 2) are thin copper patterns that are formed on a printed circuit board base using standard etching techniques, similar to those used to form the conductive patterns on printed circuit boards.

At the end of the baton is a small electrode which functions as a radio frequency transmitter antenna 142. The amount of capacitive coupling between a baton transmitter antenna 142 and each of the four antennae in the sensor 110 is measured by measuring the strength of the RF signal received by each of the four antennae at the frequency which corresponds to that baton.

Figure 1B:
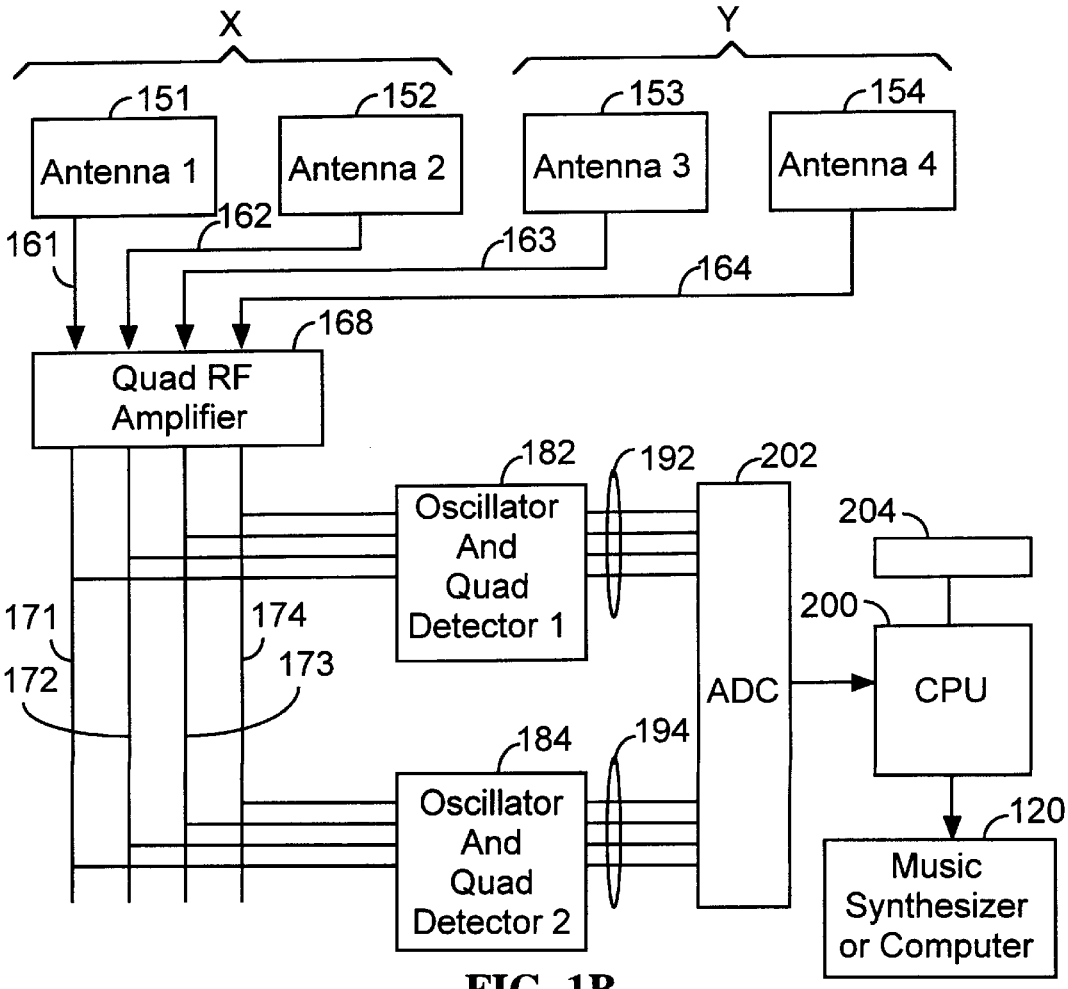
FIG. 1B is a detailed block diagram of a system incorporating the present invention.

Referring now to FIG. 1B, and as described above, the sensor 110 contains four antennae 151, 152, 153 and 154. The radio frequency signals received by each of these four antennae, via capacitive coupling between the batons and the antennae, are carried on lines 161, 162, 163 and 164 to a set of four RF amplifiers 168, which generate four amplified antennae signals on lines 171, 172, 173 and 174.

For each baton there is an oscillator and detector circuit 182 (for baton 102), 184 (for baton 104) which generates an RF signal at a distinct RF frequency, and which also detects the strength of the four antennae signals on lines 171–174 at that RF frequency. The detector 182 generates four dc voltage signals on lines 192 which correspond to the strengths of the four antennae signals at the RF frequency transmitted by baton 102. Similarly, detector 184 generates four dc voltage signals on lines 194 which correspond to the strengths of the four antennae signals at the RF frequency transmitted by baton 104.

The DC voltage signals which represent the strengths of the antennae signals from each of the baton are then read into a small digital computer or CPU 200 via an analog to digital converter 20 (ADC) 202, which sequentially converts each of the voltage signals into a digitally encoded value. All eight voltage signals are read by the CPU 200 on a periodic basis (e.g., one thousand times per second) and then the CPU, under the control of software 204, uses these received values to compute the X, Y, and Z coordinates of each of the batons 102 and 104. These values are then converted into MIDI control parameters which are transmitted to a standard music synthesizer, such as the Yamaha DX7, which then responds to those MIDI control parameters by generating corresponding musical sounds. Alternately, they may be sent to a computer, which after processing the signals from the baton, sends commands to a music synthesizer.

In the preferred embodiment we use parameters X1, Y1 and Z1 to denote the (X,Y,Z) position of the transmitter at the end of the first baton 102, and we use X2, Y2 and Z2 to denote the position of the transmitter at the end of the second baton 104. Given these six parameters, the X1 and Y1 parameters may be used to control the frequency and volume of a first MIDI channel, and X2 and Y2 may be used to control the frequency and volume of a second MIDI channel. A MIDI event, comprising a note or drumbeat, is then played on each MIDI channel whenever the corresponding Z value reaches a predefined threshold value (e.g., Z=0), which corresponds to the baton hitting the surface 112 of the sensor 110.

U.S. Pat. No. 4,980,519, incorporated by reference above, describes a technique for accurately determining the time at which a baton hits the surface of the capacitive sensor and for determining the velocity of the baton at the time of impact.

Figure 2:
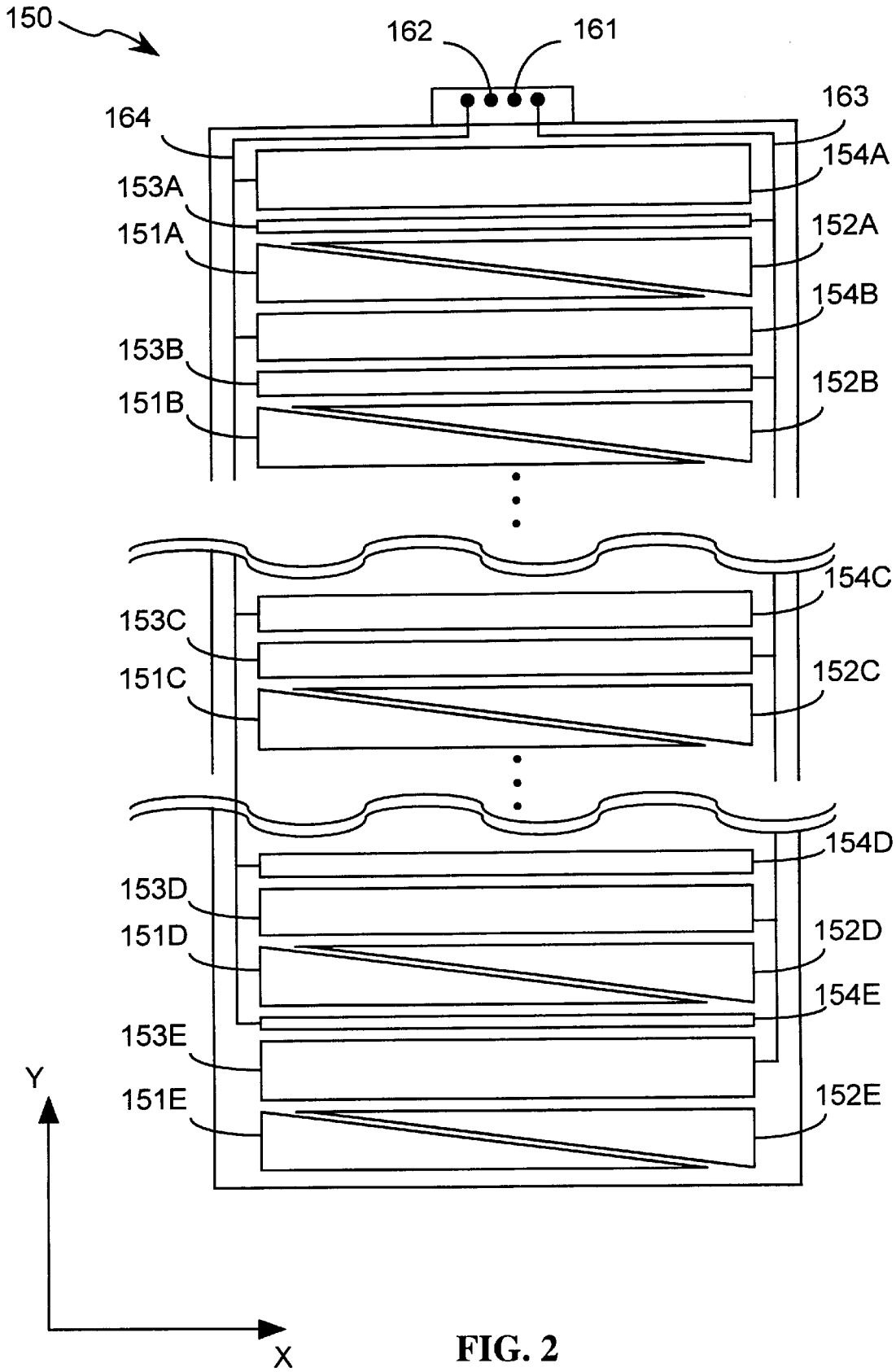
FIG. 2 illustrates a printed circuit board metalization pattern that forms the capacitive electrodes of the receiver antenna used in a preferred embodiment of the present invention.

FIG. 2 illustrates three portions of the pattern 150 printed on the top surface of a printed circuit board, with electrode regions forming the four antennae 151–154 of sensor 110.

The first pair of antennae 151, 152 (also sometimes called electrodes) are formed from a plurality of pairs of wedge shaped regions 151A–151E and 152A–152E, and the second pair of antennae 153, 154 are formed from a plurality of pairs of rectangular shaped regions 153A–153E and 154A–154E. As shown, the pairs of rectangular shaped regions are interleaved with the plurality of pairs of wedge shaped regions.

The size of the antenna regions relative to the printed circuit board have been enlarged for clarity. Antenna 151 is comprised of a plurality of wedge shaped regions 151A–151E. For simplicity, only five regions have been shown, in one embodiment each antenna is comprised of approximately twenty-five regions. Similarly, antenna 152 is comprised of a plurality wedge shaped regions 152A–152E. Each of the electrode regions comprising antenna 151 are coupled together using vias to a second layer of the printed circuit board by trace 161 illustrated in FIG. 3. Each of the electrode regions comprising antenna 152 are coupled together by trace 162. The width of each antenna region 151A–151E decreases linearly in the X direction and the width of each antenna region 152A–152E increases linearly in the X direction. The width of each of the regions 151A–151E at a given X position is the same for any given Y position. This is also true for regions 152A–152E. Thus as a positioning member moves across the surface of the sensor in the Y direction, the width of each of the regions 151A–151E is the same. Similarly, the width of each of the regions 152A–152E is the same. However, at X positions other than the center of the sensor, the width of regions 151A–151E is different from the width of regions 152A–152E. In other words, the widths of the antenna electrode regions 151A–151E and 152A–152E do not vary in the Y direction.

Antennae 153 and 154 are comprised of narrow rectangular electrode regions 153A–153E, and electrode regions 154A–154E respectively. The widths of these electrode regions are constant in the X direction. The widths of antenna electrode regions 153A–153E decrease linearly with increasing Y, and the widths of electrode regions 154A–154E increase linearly with increasing Y.

As indicated above, FIG. 2 is not drawn to scale. In a preferred embodiment, the combined width of each pair of electrode regions $\mathbf{153}_x$, $\mathbf{154}_x$, including the space occupied by a thin nonconductive strip between the regions, is about 0.57 centimeters (0.225 inches). Similarly the combined width (at any and all X positions) of each pair of electrode regions $151_x$, $152_x$, including the space occupied by a thin nonconductive strip between the regions, is about 0.57 centimeters (0.225 inches). The length of these regions will depend on the size of the capacitive tablet, but will typically be between fifteen and fifty centimeters, with all of the regions in a particular capacitive tablet having the same length.

The radio frequency signals received by each of these four antennae 151–154, via capacitive coupling between the batons and the antennae, are coupled to receiver electronics 130 (FIG. 1) for processing.

Capacitance is measured by transmitting a low frequency signal from baton transmitter 142 and measuring the signal received at the antennae 151–154. Capacitance is a linear function of the area of a capacitor's electrodes. Capacitance is also inherently a strongly non-linear function of the distance between two electrodes. Capacitance changes rapidly when the electrodes are close together and slowly when they are far apart. The ratios of the areas of the antenna electrode regions comprising antennae 151 and 152 depend linearly on the X position of baton transmitter 142, and are independent of the Y position. The ratios of the local areas of the antenna electrode regions comprising antennae 153 and 154 depend linearly on the Y position of baton transmitter 142, and are independent of the X position. Thus by measuring the capacitance values between baton transmitter 142 and the four antennae 151–154, the X, Y position of baton transmitter 142 can be computed with uniform accuracy anywhere in the X-Y plane. To avoid granularity in the antennae output signals, the widths of the antennae electrode wedges and rectangles should be small compared with the dimension of the baton transmitter electrode 142. This design criterion can be readily satisfied with conventional printed circuit board fabrication techniques.

Except for thin strips of insulation between the antennae 151–154, the four antennae completely occupy the area of the sensor top surface 112. The sum of the capacitances to all four antennae provides a measure of the Z position of baton transmitter 142, e.g. the distance between the baton transmitter 142 and the sensor top surface 112. This measure of Z is independent of the X and Y positions of the baton.

Figure 3:
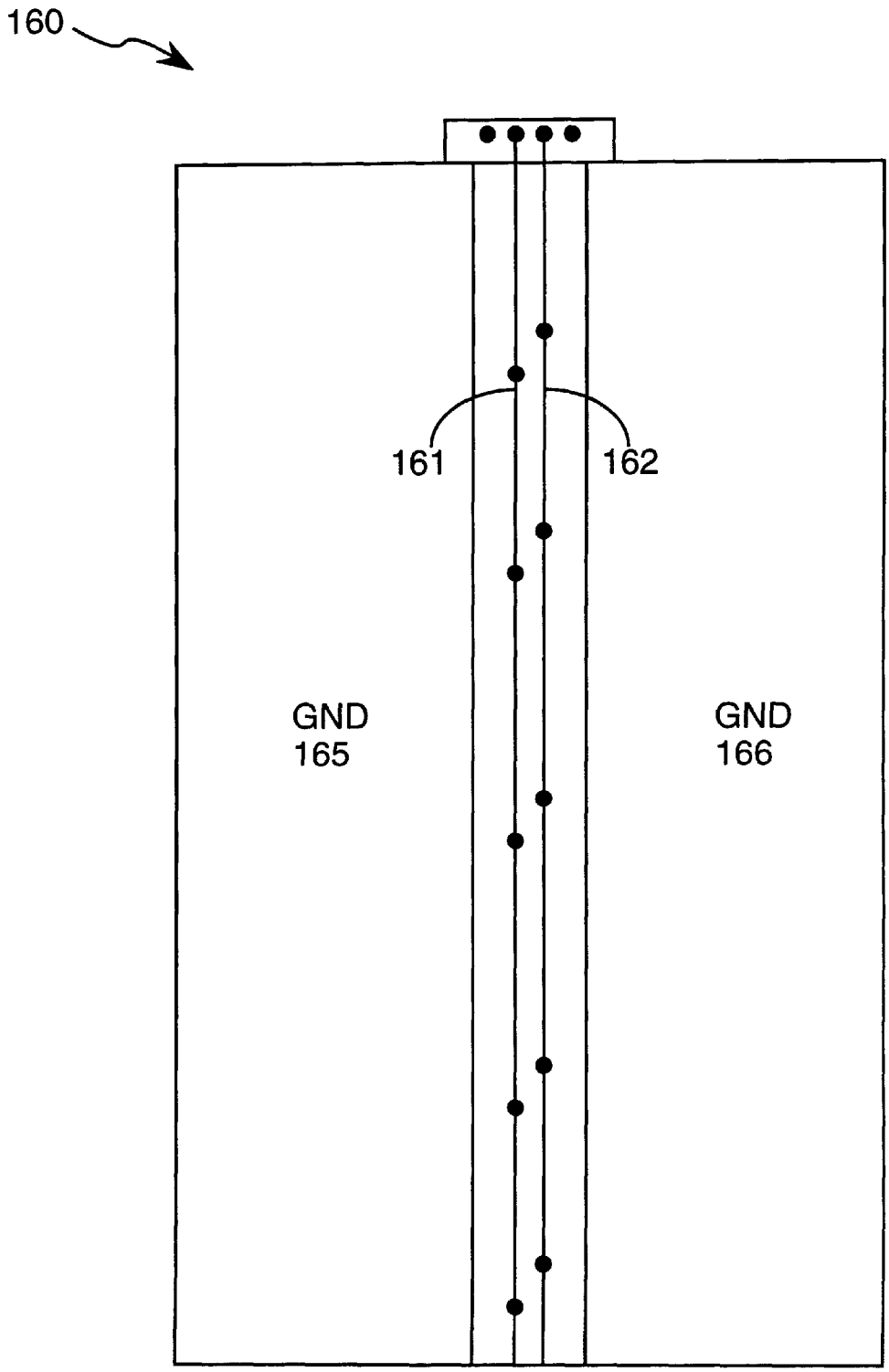
FIG. 3 illustrates a printed circuit board metalization pattern that forms the ground layer for the receiver antenna according to a preferred embodiment of the present invention.

FIG. 3 illustrates a ground plane for the receiver antenna. In a preferred embodiment, the antennae 151–154 illustrated in FIG. 2 are formed on one side of a printed circuit board and the ground layer 160 is fabricated on the other side of the printed circuit board. Ground layer 160 consists of two large ground planes 165 and 166, and two traces 161 and 162 between the ground planes. Trace 161 couples the electrode regions $151_x$ of antenna 151, and trace 162 couples the antenna electrode regions $152_X$.

The equations relating capacitance measurements to the X and Y baton position, for the antenna geometry of the present invention, are straightforward and facilitate fast, efficient determinations of the baton position. The "local" capacitance between baton transmitter 142 and one of the receiver antennae 151–154 is proportional to the "area" of the antenna region at the particular value of X or Y. Thus, the equations relating capacitance to the X position are:

$$C1=K(1-X)\quad 0<X<1$$

$$C2=K(X)$$

$$R_X=\frac{C1}{C2}=\frac{(1-X)}{X} \tag{1}$$

$$X=\frac{1}{(1+R_X)}$$

where C1 and C2 arc the measured capacitance values between the baton transmitter 142 and the receiver antennae 151 and 152 respectively, $R_X$ is the ratio of these capacitance values, and the width of the active region of the capacitive tablet has been normalized to one. In other words, the value X computed using the equations shown above is a value between 0 and 1 that indicates the X position of the baton as a percentage of the width of the active region of the capacitive tablet. (The width of the capacitive table can also be described as the length of the individual antennae regions on the capacitive tablet.) The position X' of the baton, measured in unit of inches, centimeters or the like is obtained by multiplying X by the width of the active region of the capacitive tablet.

Similarly to compute the Y position of a baton, the following equations are used:

$$C3=K(1-Y)\quad 0<Y<1$$

$$C4=K(Y)$$

$$R_Y=\frac{C3}{C4}=\frac{(1-Y)}{Y} \tag{2}$$

$$Y=\frac{1}{(1+R_Y)}$$

where C3 and C4 are the measured capacitance values between the baton transmitter 142 and the receiver antennae 153 and 154 respectively and the length of the active region of the capacitive tablet has been normalized to one. The value Y computed using the equations shown above is a value between 0 and 1 that indicates the Y position of the baton as a percentage of the length of the active region of the capacitive tablet. The position Y' of the baton, measured in unit of inches, centimeters or the like is obtained by multiplying Y by the length of the active region of the capacitive tablet.

The Z coordinate can also be calculated. Z is a monotonic decreasing function of the sum of the signals from all four antennae. Although this function is strongly nonlinear, it can easily be represented as a table lookup function in the CPU's baton signal processing software 204. The accuracy of the computed Z coordinate is dependent on knowledge of the signal strength of the signal transmitted by the baton, whereas the accuracy of the computer X and Y coordinates is independent of the strength of the signal transmitted by the baton.

The same calculations are used to determine the (X2, Y2, Z2) position of the second baton 104, except that the measured capacitance values (i.e., measured voltages) used in this second set of calculations correspond to the strength of the signals received at the frequency transmitted by the second baton 104.

Figure 4:
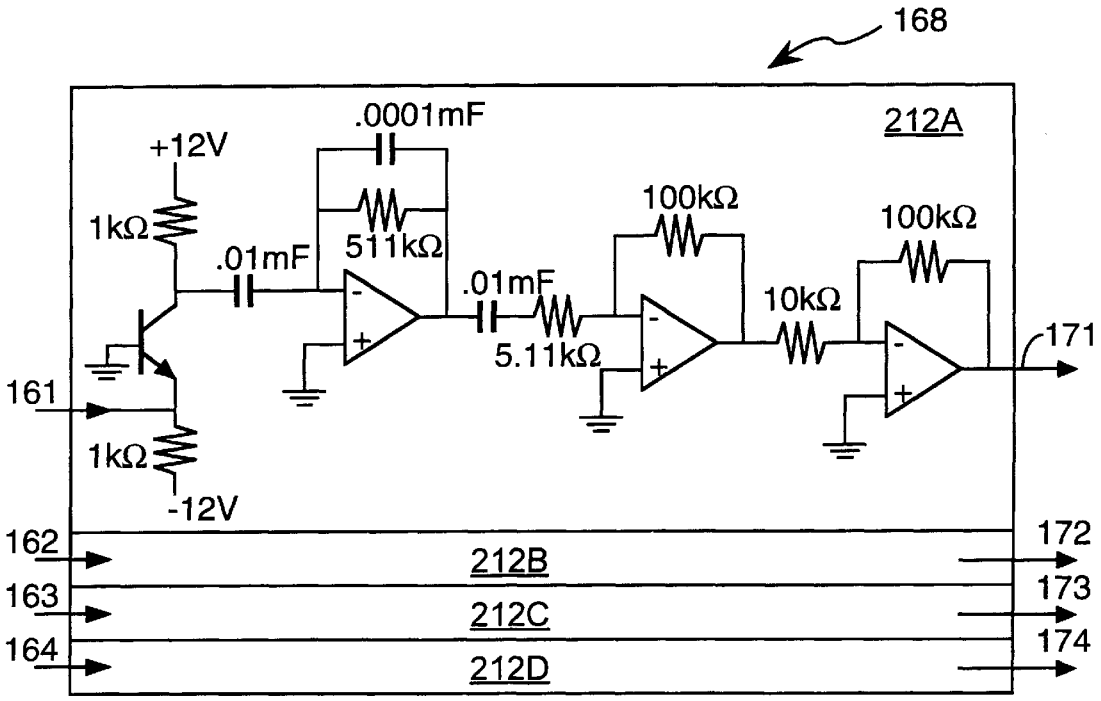
FIG. 4 illustrates a radio frequency amplifier.

FIG. 4 shows the Quad-radio frequency amplifier 168 used in the receiver electronics 130. The quad RF amplifier 168 has four RF amplifiers 212A–212D. Each amplifier 212 is a three stage pre-amplifier circuit suitable for amplifying the range of RF signals used in the preferred embodiment. The input to each of the RF amplifiers 212 is coupled to a respective one of the four antenna output lines 161, 162, 163 and 164. The output lines 171, 172, 173, 174 from the four RF amplifiers 212 go to the oscillator and detector circuits 182 and 184.

Figure 5:
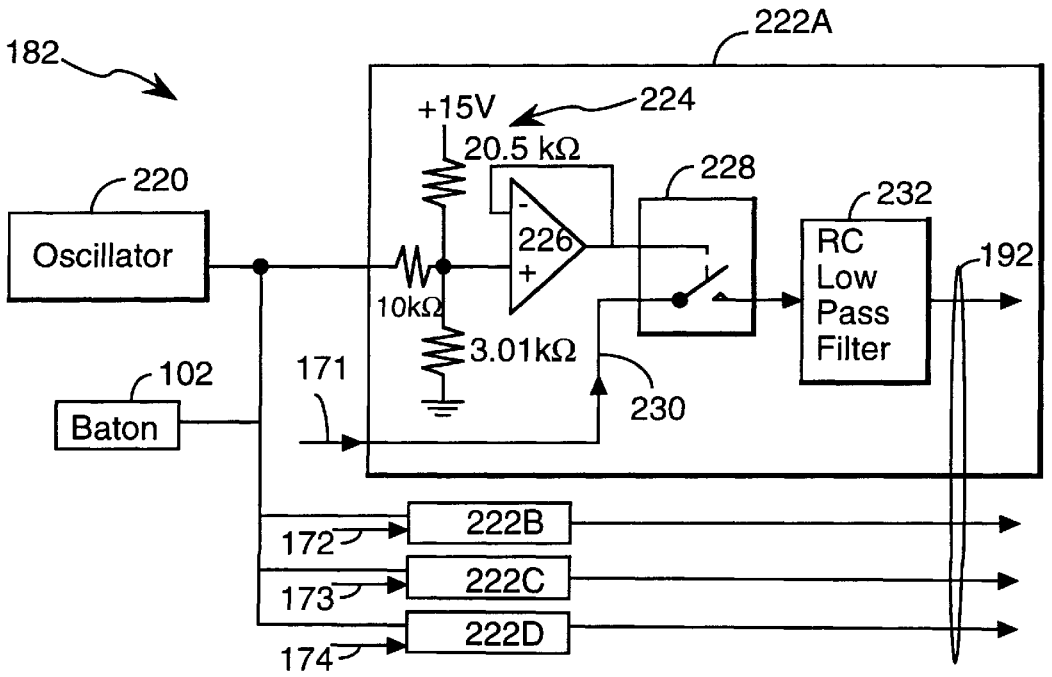
FIG. 5 illustrates an oscillator and radio frequency signal detector.

FIG. 5 shows an oscillator and signal detector 182, including an oscillator 220 which generates a periodic signal having a period of 13.2 microseconds, which corresponds to a frequency of 75.76 Khz. The oscillator 220 is coupled to four RF signal detectors 222A–222D as well as baton 102.

Thus, the same RF signal from the oscillator 220 is used to generate the RF signal transmitted by the baton 102 and to drive a set of four RF signal detectors 222A–222D.

In a system with more than one baton, for each distinct baton 102, there is a corresponding oscillator 220 and set of four RF signal detectors 222A–222D. Each baton uses a distinct RF frequency so that the signals from each baton can be separately detected. While a preferred embodiment has just two batons, other embodiments could use three, four or more batons, each with its own oscillator having a distinct RF frequency and a corresponding set of RF signal detectors.

Each radio frequency signal detector circuit 222 includes an input voltage divider 224, followed by an operational amplifier 226 (e.g., an LF347), followed by a sampling circuit 228 (e.g., an LF13202) which samples an amplified input signal on line 230 at the running frequency of the oscillator circuit 220. Input line 230 is coupled to output line 171 of one of the RF amplifiers, such as the one shown in FIG. 4. The input lines of the other three RF signal detector circuits 222B, 222C and 222D are coupled to the output signal lines 172, 173 and 174 of the other RF amplifiers.

The output of the sampling circuit 228 is filtered by an RC low pass filter 232 so as to produce a stable DC output signal on line 192, which is proportional to the strength of the RF signal received by one of the antennae.

In a preferred embodiment receiver electronics 130 provides X, Y and Z position information to music synthesizer 120 at predetermined time intervals. Alternatively, receiver electronics 130 can send a continuous stream of information to the music synthesizer. In this case, a program will compute X, Y and Z (for each baton) and will send these data to a computer at each sampling time. The continuous stream of information can be used to control nonpercussive timbres such as violin timbres. For example, X might control loudness of the sound and Y the strength of the vibrato.

In many applications, the values of X and Y are meaningful only if the baton is close to the sensor surface. The program can be made to send X and Y information (i.e., values) to the computer only when Z is less than a specified threshold. In this way, the computer will not be overloaded with meaningless information.

In yet other variations of the program, the program can be arranged so that one baton sends trigger signals to the computer and another baton sends a continuous stream of X, Y and Z values. Alternatively, the same baton can send both triggers and a continuous stream of X, Y and Z values to a computer. If desired, X and Y values can be sent only while the baton is close to the surface of the drum immediately subsequent to generating a trigger signal. Thus the trigger can be used to initiate a note and the subsequent X and Y data can be used to shape the sound of the note.

In some embodiments of the present invention, the receiver electronics 130 (FIG. 1) or computer 200 (FIG. 1B) compute only the X and Y coordinates of one or more moveable positioning members (e.g., batons 102, 104). Also, in alternate embodiments of the present invention, the receiver electronics 130 (FIG. 1) or computer 200 (FIG. 1B) may compute the position of the moveable positioning member in terms of an alternate coordinate system, such as a radial coordinate system.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A position sensor, comprising:

a moveable positioning member that generates a signal at a specified position in space, the position being specifiable with respect to X, Y and Z axes;

antennae comprising a flat support member having a first surface with at least two pairs of electrodes mounted on the first surface of the flat support member, a first pair of the electrodes comprising complementary wedge shaped electrodes positioned adjacent to each other so that capacitive coupling between the moveable positioning member and the first electrode pair corresponds to the position of the moveable positioning member with respect to the X axis and does not depend on the position of the moveable positioning member with respect to the Y axis, and a second pair of the electrodes comprising complementary rectangular shaped electrodes positioned adjacent to each other so that capacitive coupling between the moveable positioning member and the second electrode pair corresponds to the position of the moveable positioning member with respect to the Y axis and does not depend on the position of the moveable positioning member with respect to the X axis; and a computation module for receiving signals from the electrodes, for computing X and Y position values of the moveable positioning member, and for computing a Z position value which is inversely proportional to the sum of the received signals.

2. The position sensor of claim 1, wherein the first pair of electrodes comprises a plurality of pairs of wedge shaped regions, and the second pair of electrodes comprises a plurality of pairs of rectangular shaped regions, wherein the pairs of rectangular shaped regions are interleaved with the plurality of pairs of wedge shaped regions.

3. The position sensor of claim 2, wherein the first pair of electrodes develop a first pair of signals, S1 and S2, in response to the signal generated by the moveable positioning member, and the second pair of electrodes develop a second pair of signals, S3 and S4, in response to the signal generated by the moveable positioning member; and the X position value is a function of the ratio of S1 to S2, and the Y position value is a function of the ratio of S3 to S4.

4. The position sensor of claim 3, wherein the X position value corresponds to the value of $$\frac{1}{1+S1/S2},$$

and the Y position value corresponds to the value of $$\frac{1}{1+S3/S4}.$$

5. The position sensor of claim 4 wherein the wedge shaped regions and the rectangular shaped regions each span substantially across a width of the first surface.

6. A position sensor, comprising:

antennae comprising a flat support member having a first surface with at least two pairs of electrodes mounted on the first surface of the flat support member, a first pair of the electrodes comprising complementary wedge shaped electrodes positioned adjacent to each other so that capacitive coupling between a moveable positioning member and the first electrode pair corresponds to the position of the moveable positioning member with respect to the X axis and does not depend on the position of the moveable positioning member with respect to the Y axis, and a second pair of the electrodes comprising complementary rectangular shaped electrodes positioned adjacent to each other so that capacitive coupling between the moveable positioning member and the second electrode pair corresponds to the position of the moveable positioning member with respect to the Y axis and does not depend on the position of the moveable positioning member with respect to the X axis; and a computation module for receiving signals from the electrodes, for computing X and Y position values of the moveable positioning member.

7. The position sensor of claim 6, wherein the first pair of electrodes comprises a plurality of pairs of wedge shaped regions, and the second pair of electrodes comprises a plurality of pairs of rectangular shaped regions, wherein the pairs of rectangular shaped regions are interleaved with the plurality of pairs of wedge shaped regions.

8. The position sensor of claim 7, wherein the first pair of electrodes develop a first pair of signals, S1 and S2, in response to a signal generated by the moveable positioning member, and the second pair of electrodes develop a second pair of signals, S3 and S4, in response to the signal generated by the moveable positioning member; and the X position value is a function of the ratio of S1 to S2, and the Y position value is a function of the ratio of S3 to S4.

9. The position sensor of claim 8, wherein the X position value corresponds to the value of $$\frac{1}{1+S1/S2},$$

and the Y position value corresponds to the value of $$\frac{1}{1+S3/S4}.$$

10. The position sensor of claim 9 wherein the wedge shaped regions and the rectangular shaped regions each span substantially across a width of the first surface.

11. A position sensor, comprising:

a moveable positioning member that generates a signal at a specified position in space, the position being specifiable with respect to X and Y axes;

antennae comprising a flat support member having a first surface, with an array of sensor modules mounted on the first surface of the flat support member, each module of said array including:

a first sensor with a first fixed capacitance along the X axis;

a second sensor with a second fixed capacitance along the X axis;

a third sensor with a capacitance that increases along the X axis; and a fourth sensor with a capacitance that decreases along the X axis;

wherein the first and second sensors are positioned along the Y axis such that the magnitude of said first fixed capacitance is proportional to the position of the sensor module along the Y axis and the magnitude of said second fixed capacitance is inversely proportional to the position of the sensor module along the Y axis; and a computation module for receiving signals from the sensors, for computing X and Y position values of the moveable positioning member.

12. The position sensor of claim 11, wherein said third sensor and said fourth sensor of each of said sensor modules are wedge shaped regions, and said first sensor and said second sensor of each of said sensor modules are rectangular shaped regions, wherein the rectangular shaped regions are interleaved with the wedge shaped regions.

13. The position sensor of claim 12, wherein the third sensor and fourth sensor of a sensor module develop a first pair of signals, S1 and S2, in response to the signal generated by the moveable positioning member, and the first sensor and second sensor of a sensor module develop a second pair of signals, S3 and S4, in response to the signal generated by the moveable positioning member; and the X position value is a function of the ratio of S1 to S2, and the Y position value is a function of the ratio of S3 to S4.

14. The position sensor of claim 13, wherein the X position value corresponds to the value of $$\frac{1}{1+S1/S2},$$

and the Y position value corresponds to the value of $$\frac{1}{1+S3/S4}.$$

15. The position sensor of claim 14 wherein the wedge shaped regions and the rectangular shaped regions each span substantially across a width of the first surface.

16. A position sensor for use in conjunction with a moveable positioning member that generates a signal at a specified position in space, the position being specifiable with respect to X and Y axes. the position sensor comprising:

antennae comprising a flat support member having a first surface, with an array of sensor modules mounted on the first surface of the flat support member, each module of said array including:

a first sensor with a first fixed capacitance along the X axis;

a second sensor with a second fixed capacitance along the X axis;

a third sensor with a capacitance that increases along the X axis; and a fourth sensor with a capacitance that decreases along the X axis;

wherein the first and second sensors are positioned along the Y axis such that the magnitude of said first fixed capacitance is proportional to the position of the sensor module along the Y axis and the magnitude of said second fixed capacitance is inversely proportional to the position of the sensor module along the Y axis; and a computation module for receiving signals from the sensors, for computing X and Y position values of the moveable positioning member.

17. The position sensor of claim 16, wherein said third sensor and said fourth sensor of each of said sensor modules are wedge shaped regions, and said first sensor and said second sensor of each of said sensor modules are rectangular shaped regions, wherein the rectangular shaped regions are interleaved with the wedge shaped regions.

18. The position sensor of claim 17, wherein the third sensor and fourth sensor of a sensor module develop a first pair of signals, S1 and S2, in response to the signal generated by the moveable positioning member, and the first sensor and second sensor of a sensor module develop a second pair of signals, S3 and S4, in response to the signal generated by the moveable positioning member; and the X position value is a function of the ratio of S1 to S2, and the Y position value is a function of the ratio of S3 to S4.

19. The position sensor of claim 18, wherein the X position value corresponds to the value of $$\frac{1}{1+S1/S2},$$

and the Y position value corresponds to the value of $$\frac{1}{1+S3/S4}.$$

20. The position sensor of claim 19 wherein the wedge shaped regions and the rectangular shaped regions each span substantially across a width of the first surface.

* * * * *